US008858106B2

(12) United States Patent
Ota et al.

(10) Patent No.: US 8,858,106 B2
(45) Date of Patent: Oct. 14, 2014

(54) IMAGE RECORDING DEVICE

(75) Inventors: Yasuhira Ota, Yatomi (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 407 days.

(21) Appl. No.: 12/893,744

(22) Filed: Sep. 29, 2010

(65) Prior Publication Data

US 2011/0236118 A1 Sep. 29, 2011

(30) Foreign Application Priority Data

Mar. 24, 2010 (JP) ..... 2010-067359

(51) Int. Cl.
*B41J 13/10* (2006.01)
*B41J 3/407* (2006.01)
*B41J 11/20* (2006.01)

(52) U.S. Cl.
CPC ..... *B41J 11/20* (2013.01); *B41J 3/4071* (2013.01); *B41J 13/10* (2013.01)
USPC ..... 400/642; 400/578; 101/35; 347/104

(58) Field of Classification Search
USPC ..... 400/642
See application file for complete search history.

(56) References Cited

U.S. PATENT DOCUMENTS 5,818,487 A * 10/1998 Yoshimura et al. ..... 347/104
6,148,722 A * 11/2000 Hagstrom ..... 400/682
6,332,680 B1 * 12/2001 Ozawa ..... 347/104
6,612,762 B1 * 9/2003 Sakurai et al. ..... 347/104
6,712,463 B2 * 3/2004 Matsumoto ..... 400/642
6,755,494 B2 * 6/2004 Park ..... 347/104
6,814,436 B2 * 11/2004 Anami et al. ..... 347/104
7,101,096 B2 * 9/2006 Sasai et al. ..... 400/48
7,309,123 B2 * 12/2007 Anami et al. ..... 347/104
2006/0187290 A1 * 8/2006 Nakashima ..... 347/104

FOREIGN PATENT DOCUMENTS

JP 2002-308493 A 10/2002
JP 2006-298618 A 11/2006
JP 2007-136802 A 6/2007
JP 2009-096021 A 5/2009

OTHER PUBLICATIONS

Japan Patent Office, Notice of Reasons for Rejection for Japanese Patent Application No. 2010-067359 (counterpart to above-captioned patent application), mailed Apr. 17, 2012.

(Continued)

*Primary Examiner* — Jill Culler
(74) *Attorney, Agent, or Firm* — Baker Botts L.L.P.

(57) ABSTRACT

An image recording device includes a tray having a recess, a recording unit, a drive roller, a first driven roller, a second driven roller, a first urging member and a second urging member. The first driven roller is movable between a first basic position to contact the drive roller and press with a first force and a first nip position to press a first portion, corresponding to the recess, with a third force. The second driven roller is movable between a second basic position to contact the drive roller and press with a second force and a second nip position to press a second portion, not corresponding to the recess, with a fourth force. A difference between the first force and the second force is smaller than a difference between the third force and the fourth force, and the third force is smaller than the fourth force.

13 Claims, 10 Drawing Sheets

(56) References Cited

OTHER PUBLICATIONS

The State Intellectual Property Office of the People'S Republic of China, Notification of First Office Action for Chinese Patent Application No. 201010502368.X (counterpart Chinese patent application), issued Jan. 30, 2013.

The State Intellectual Property Office of the People'S Republic of China, Notification of Second Office Action for Chinese Patent Application No. 201010502368.X (counterpart Chinese patent application), issued Jul. 25, 2013.

* cited by examiner

IMAGE RECORDING DEVICE

CROSS REFERENCE TO RELATED APPLICATION

The present application claims priority from Japanese Patent Application No. 2010-067359, which was filed on Mar. 24, 2010, the disclosure of which is incorporated herein by reference in its entirety.

BACKGROUND

1. Field of the Invention

The present invention relates to an image recording device which conveys a tray placing thereon a recording medium by nipping the tray with a roller pair and records an image on the recording medium.

2. Description of the Related Art

An image recording device in which a recording medium is placed on a special tray to record an image is known. An upper surface of the tray has a placing portion having a concave shape. A recording medium is placed on the concave and fed in the image recording device while being nipped by a roller pair, and an image is recorded thereon.

The thickness in the vertical direction of the region in the tray provided with the placing portion is less than the thickness of the region in the tray not provided with the placing portion. In other words, the tray is lower in rigidity in the central portion in the width direction than in the side end portions in the width direction. Thus, the regions in the tray having different rigidities are applied with the pressing force by the roller, and thereby the tray may warp and the recording medium placed on the tray may become unstable.

SUMMARY

A need has arisen to provide an image recording device which stabilizes the height of a surface of a recording medium placed on a tray, on which an image is to be recorded, and thereby is capable of recording a high-quality image on the recording medium.

According to an embodiment of the present invention, an image recording device includes a tray, a recording unit, a drive roller, a first driven roller, a second driven roller, a first urging member and a second urging member. The tray has a recess capable of placing thereon a recording medium. The recording unit is configured to record an image on the recording medium. The drive roller is configured to feed the tray having the recording medium placed on the recess by rotating with a drive force transmitted from a drive source. The first driven roller is disposed facing the drive roller. The second driven roller is disposed facing the drive roller. The first urging member is configured to urge the first driven roller toward the drive roller. The second urging member is configured to urge the second driven roller toward the drive roller. The first driven roller is movable between a first basic position where the first driven roller contacts the drive roller and presses toward the drive roller with a first force and a first nip position where the first driven roller presses a first portion of the tray, corresponding to the recess of the tray, toward the drive roller with a third force. The second driven roller is movable between a second basic position where the second driven roller contacts the drive roller and presses toward the drive roller with a second force and a second nip position where the second driven roller presses a second portion of the tray, not corresponding to the recess of the tray, toward the drive roller with a fourth force. A difference between the first force and the second force is smaller than a difference between the third force and the fourth force, and the third force is smaller than the fourth force.

DESCRIPTION OF THE PREFERRED EMBODIMENTS

Figure 1:
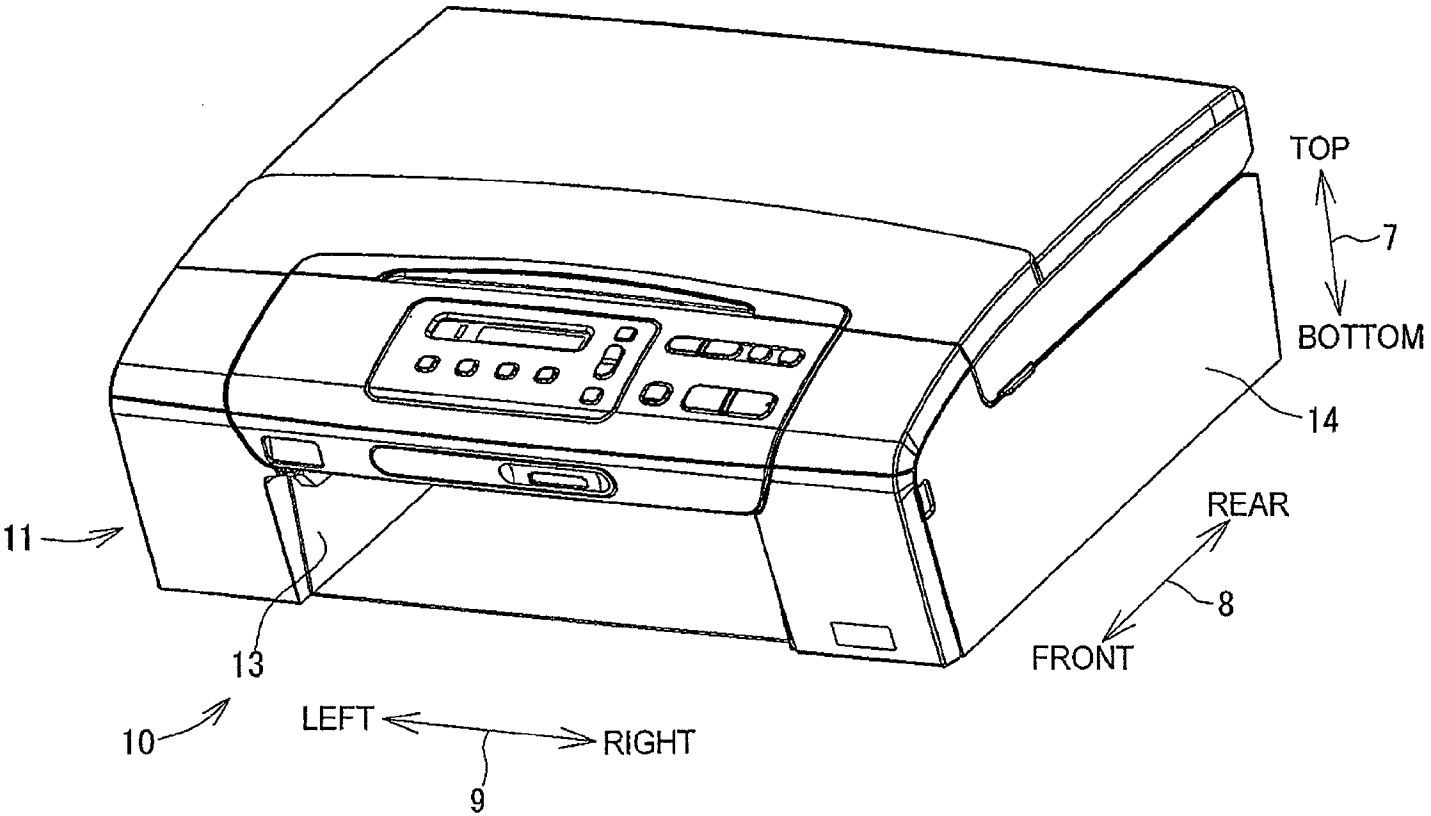
FIG. 1 is an external perspective view of a multi-function device as an embodiment example of the present invention.

An embodiment of the present invention will be described below. The embodiment described below is merely an example of the present invention, and it is needless to say that the embodiment of the present invention can be altered as required within the scope not changing the gist of the present invention. In the following description, vertical directions 7 are defined with reference to a multi-function device 10 set in the usable state (the state of FIG. 1). Further, anteroposterior directions 8 are defined with reference to the side provided with an opening 13 as the near side (front side), and horizontal directions 9 are defined with reference to the multi-function device 10 viewed from the near side (front side).

[Multi-Function Device 10]

As illustrated in FIG. 1, the multi-function device 10 as an example of the image recording device is formed into a substantially flat rectangular parallelepiped, and a lower part thereof is provided with a printer 11 according to the inkjet recording method. The multi-function device 10 has a variety of functions, such as the facsimile function and the print function. In the present embodiment, description will be made of the multi-function device 10, the print function of which is limited to the single-sided image recording function. However, multi-function device 10 may have the double-sided image recording function. The printer 11 includes a housing 14 having the opening 13 formed in the front side thereof. Through the opening 13, a feed tray 20 and a discharge tray 21 (see FIG. 2) can be inserted and extracted in the anteroposterior directions 8. A recording sheet of a desired size is placed on the feed tray 20.

Figure 2:
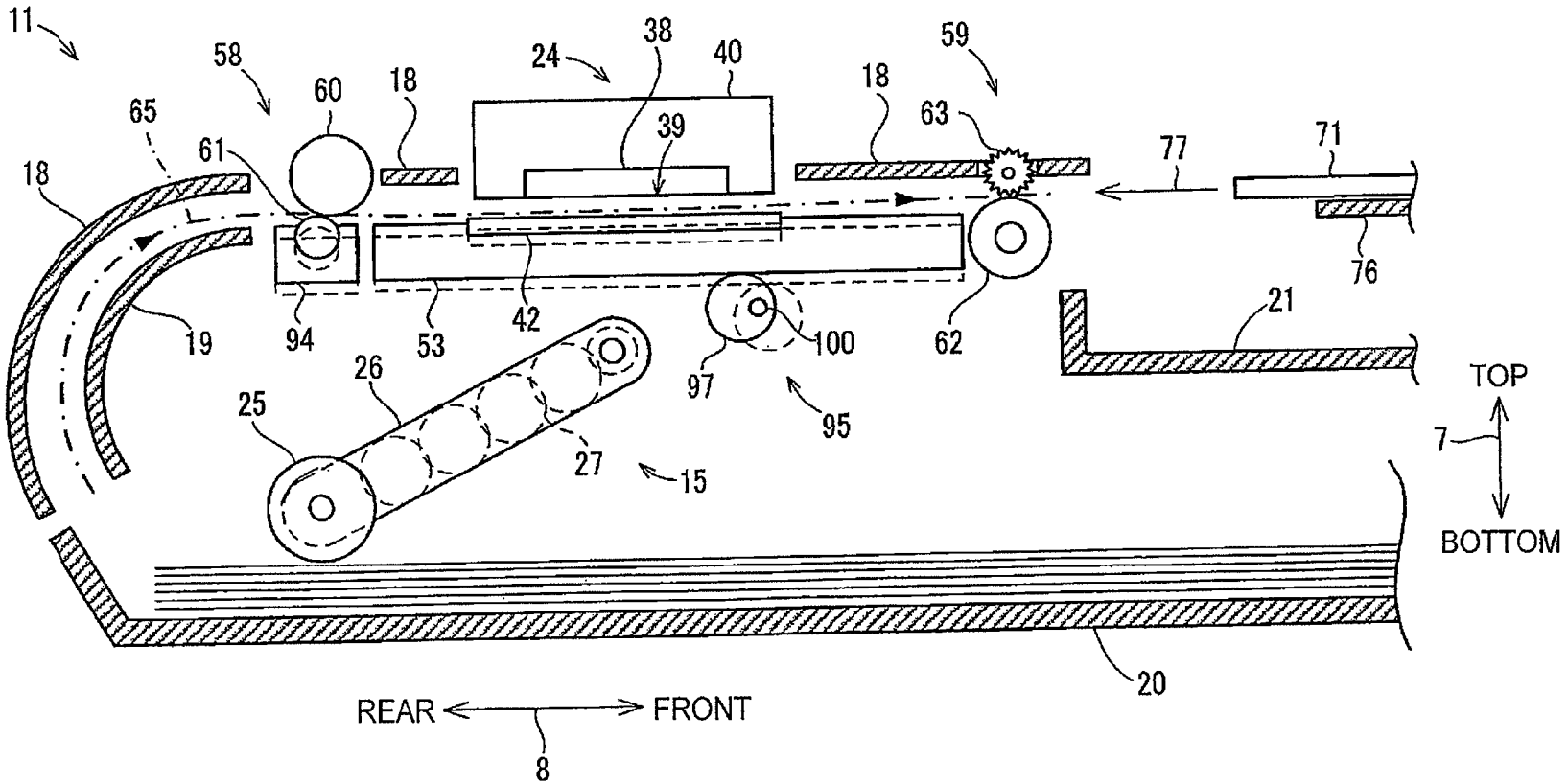
FIG. 2 is a vertical cross-sectional view schematically illustrating an internal structure of a printer.

As illustrated in FIG. 2, the printer 11 includes a feed unit 15 for feeding the recording sheet, a recording unit 24 (an example of a recording unit) according to the inkjet recording method for recording an image on the recording sheet, and so forth. The printer 11 records an image on the recording sheet on the basis of print data or the like received from an external device. Further, the multi-function device 10 has a function of recording an image on a disc surface of a recording medium thicker than the recording sheet (an example of a recording medium), such as CD-ROM (Read-Only Memory) and DVD-ROM media, by using the recording unit 4. This function will be described later.

The multi-function device 10 is formed with a path 65. The path 65 bends from a rear end portion of the feed tray 20 toward the upper side and the front side of the multi-function device 10 to extend from the rear side toward the front side of the multi-function device 10, and leads to the discharge tray 21 through the space below the recording unit 24. The recording sheet is guided through the path 65 in a conveying direction (the direction indicated by a dash-dotted arrowed line in FIG. 2). The path 65 is demarcated by an outer guide member 18 and an inner guide member 19 facing each other with a predetermined clearance interposed therebetween, and by a platen support member 53 described later.

The feed unit 15 is provided above the feed tray 20. The feed unit 15 includes a feed roller 25, a feed arm 26, and a drive transmission mechanism 27. The feed roller 25 is axially supported by the front end of the feed aim 26 which pivots in the vertical directions 7 to be contactable with and separable from the feed tray 20. The feed roller 25 rotates with drive force transmitted thereto from a feed motor (not illustrated) by the drive transmission mechanism 27 formed by a plurality of gears in mesh with one another. The feed roller 25 supplies recording sheets stacked on the feed tray 20 to the path 65 by separating the recording sheets one from another.

The recording unit 24 is provided above the path 65 extending from the rear side to the front side of the multi-function device 10. The recording unit 24 includes a carriage 40 equipped with a recording head 38 and moving back and forth in main scanning directions (directions perpendicular to the drawing plane of FIG. 2). The recording head 38 is supplied with ink from an ink cartridge (not illustrated). The recording head 38 discharges the ink from a nozzle 39 in the form of minute ink droplets. With the carriage 40 moving back and forth in the main scanning directions, the recording head 38 scans the recording sheet. Thereby, an image is recorded on the recording sheet conveyed on a platen 42 provided below the path 65 to face the recording unit 24. The platen 42 supports the recording sheet, and is supported by the platen support member 53.

[First Roller Pair 58 and Second Roller Pair 59]

On the upstream side in the conveying direction of the recording unit 24, a first roller pair 58 is provided which is formed by a first convey roller 60 (an example of a drive roller) placed above the path 65 and pinch rollers 61 placed below the path 65 to face the first convey roller 60. The first roller pair 58 nips and conveys the recording sheet onto the platen 42.

The first convey roller 60 is rotatably supported by a frame (not illustrated) of the printer 11 provided to left and right end portions of the path 65. The plurality of pinch rollers 61 are provided to be separate from one another in the horizontal directions 9. There is no limit on the number of the pinch rollers 61. In the present embodiment, description will be made on the assumption that four pinch rollers 61 (pinch rollers 141, 142, 143, and 144) (pinch roller 142, 143 disposed in the central portion is an example of a first driven roller, and pinch roller 141, 144 disposed in the side end portion is an example of a second driven roller) are provided.

As described later, the pinch rollers 141 to 144 are rotatably supported by roller support members 94 (see FIGS. 5A to 9B) at left and right end portions thereof, and are brought into pressure-contact with the roller surface of the first convey roller 60 by first resilient members 91 and second resilient members 92.

The first convey roller 60, which is an upper roller, is arranged such that the central axis thereof is located forward (downstream in the conveying direction of the recording sheet) of the central axis of each of the pinch rollers 61, which is a lower roller. Accordingly, the recording sheet is conveyed obliquely downward and pressed onto the platen 42.

On the downstream side in the conveying direction of the recording unit 24, a second roller pair 59 is provided which is formed by a second convey roller 62 placed below the path 65 and spur rollers 63 placed above the path 65 to face the second convey roller 62. The second convey roller 62 is rotatably supported by the frame (not illustrated) of the printer 11 provided to the left and right end portions of the path 65. The plurality of spur rollers 63 are provided to be separate from one another in the horizontal directions 9. Each of the spur rollers 63 is brought into pressure-contact with the roller surface of the second convey roller 62 by a resilient member (not illustrated), such as a spring. The second roller pair 59 nips and conveys the recording sheet to the discharge tray 21.

As illustrated in FIG. 2, the position at which the roller pairs 58 and 59 nip the recording sheet is above the plane on which the platen 42 supports the recording sheet.

The first convey roller 60 and the second convey roller 62 are rotated with rotational drive force transmitted thereto from a convey motor (not illustrated, an example of a drive source) via a drive transmission mechanism (not illustrated). The drive transmission mechanism is formed by planetary gears and so forth. The drive transmission mechanism rotates the rollers 60 and 62 to cause the rollers 60 and 62 to convey the recording sheet or a later-described medium tray 71 (an example of a tray) in the conveying direction when the convey motor is rotated in one of the forward direction and the reverse direction (the forward direction in the present embodiment), and to cause the rollers 60 and 62 to convey the recording sheet or the medium tray 71 in the opposite direction to the conveying direction when the convey motor is rotated in the other one of the forward direction and the reverse direction (the reverse direction in the present embodiment).

[Medium Tray 71]

As described above, the multi-function device 10 has the function of recording an image on a disc surface of a recording medium. When an image is recorded on a disc surface of a recording medium, the recording medium is placed on the medium tray 71. Placed on a tray guide 76, the medium tray 71 is inserted through the opening 13 along the path 65 in the direction of an arrow 77 opposite to the conveying direction.

Figure 3B:
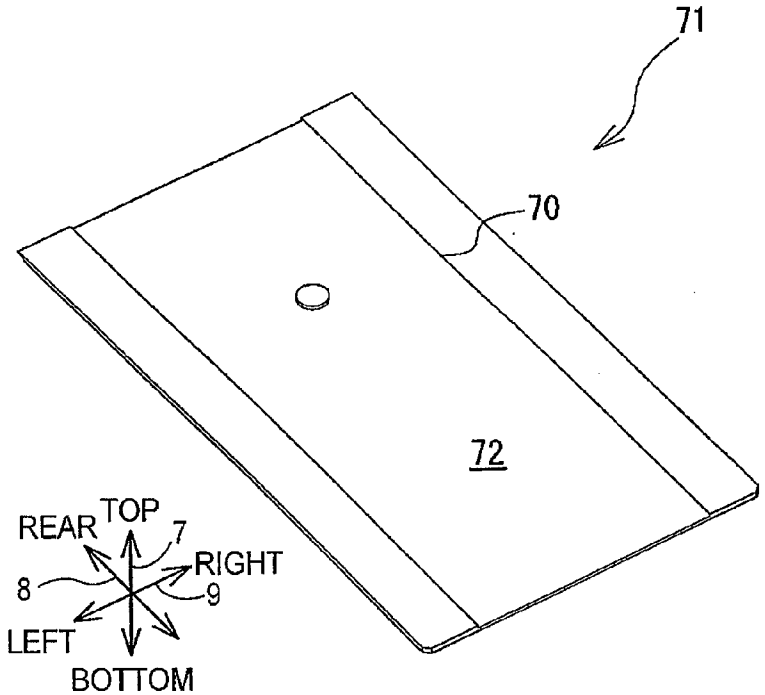
FIGS. 3A and 3B are perspective views of a medium tray, FIG. 3A illustrating the medium tray including a circular medium carrying portion, and FIG. 3B illustrating the medium tray including a non-circular medium carrying portion.
Figure 3A:
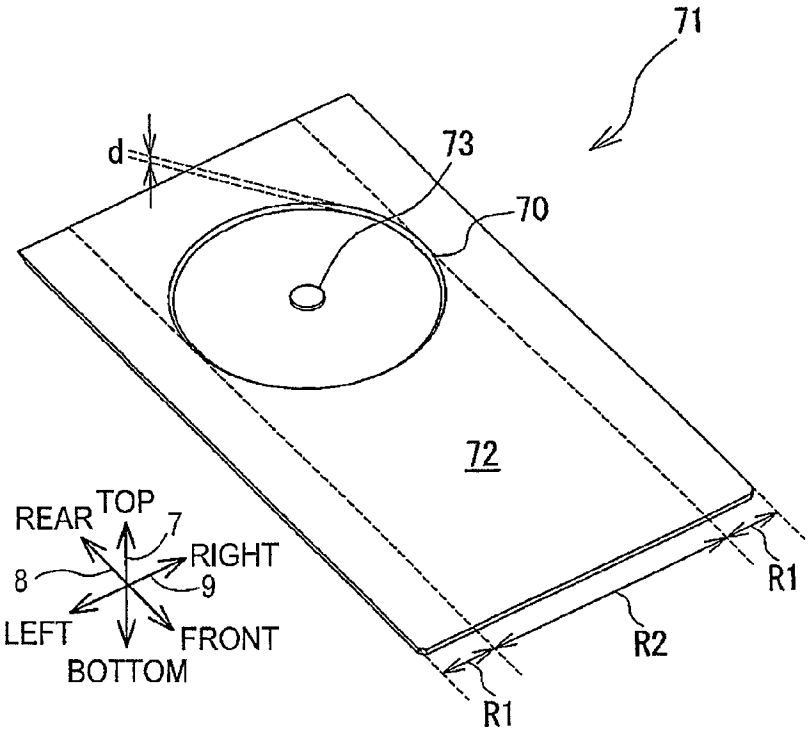

As illustrated in FIG. 3A, the medium tray 71 is a resin plate formed into a thin rectangular parallelepiped. An upper surface 72 (corresponding to a surface) of the medium tray 71 is provided with a medium carrying portion 70 (an example of a recess) for carrying thereon a recording medium. The medium carrying portion 70 is a circular recess. The recess has a diameter the same as or slightly greater than the diameter of the recording medium (e.g., a circular CD-ROM or DVD-ROM) placed thereon. Further, a central portion of the recess is provided with a circular projecting portion 73. A circular CD-ROM, DVD-ROM, or the like is provided with a circular hole at a central portion thereof. The projecting portion 73 is substantially the same in size as the hole, and thus fits in the hole. Accordingly, the recording medium placed on the medium carrying portion 70 is reduced moving in the anteroposterior directions 8 and the horizontal directions 9.

Further, the length in the vertical directions 7 of the recess, i.e., a depth d of the medium carrying portion 70 is greater than the thickness in the vertical directions 7 of the recording medium. Accordingly, the upper surface of the recording medium placed on the medium carrying portion 70 is reduced projecting upward from the upper surface 72 of the medium tray 71.

The medium carrying portion 70 may lack the projecting portion 73. Further, the medium carrying portion 70 is not limited to the circular shape. For example, as illustrated in FIG. 3B, the medium carrying portion 70 may be configured as a portion of the upper surface 72 excluding opposite end portions in the horizontal directions 9 and recessed downward in the entire area thereof extending in the anteroposterior directions 8 of the upper surface 72.

[Positions in Horizontal Directions 9 of Pinch Rollers 141 to 144]

Figure 4A:
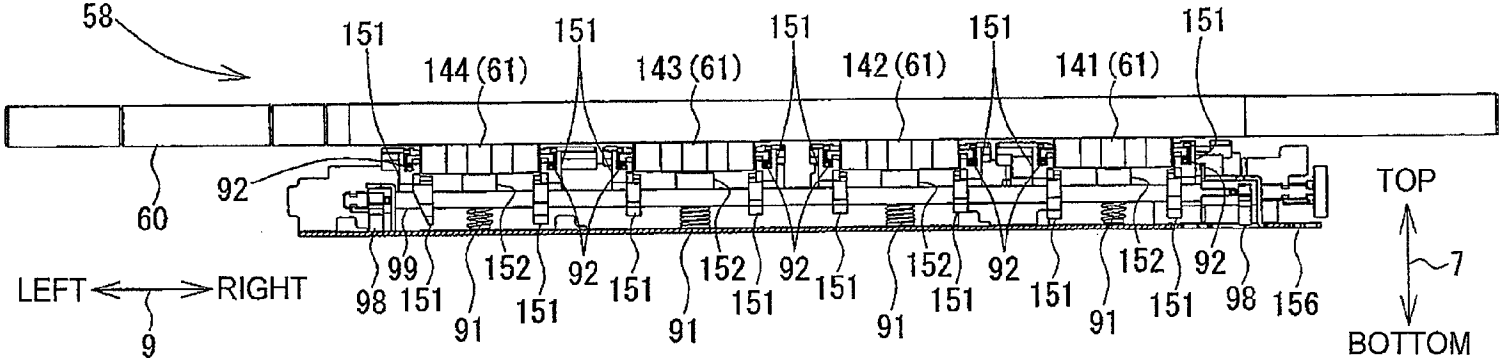
FIGS. 4A and 4B are horizontal cross-sectional views schematically illustrating a first roller pair, FIG. 4A illustrating the first roller pair conveying a recording sheet, and FIG. 4B illustrating the first roller pair conveying the medium tray.
Figure 4B:
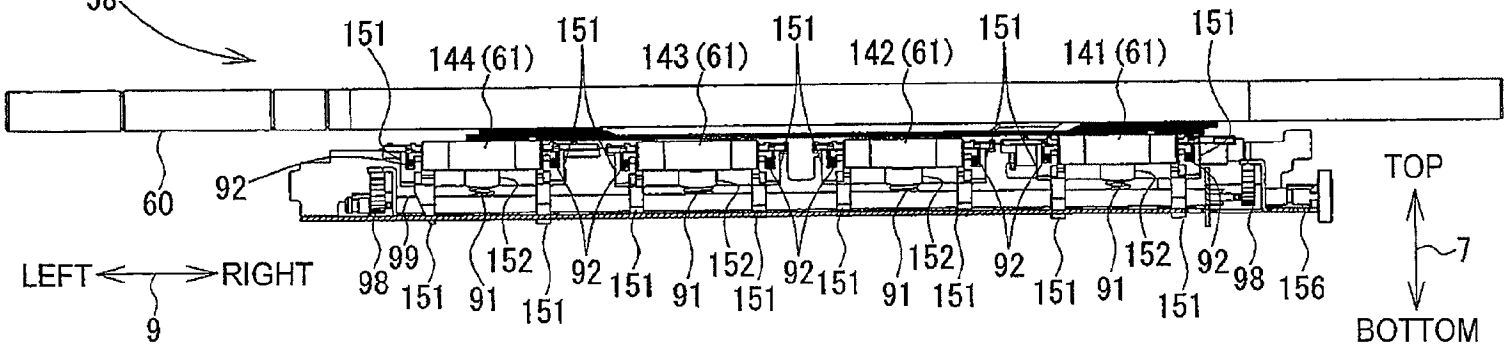

As illustrated in FIG. 4B, the medium tray 71 is nipped by the first roller pair 58, with the upper surface 72 thereof pressed by the first convey roller 60 and the lower surface thereof pressed by the pinch rollers 61. The lower surface of the medium tray 71 is formed by a first region and a second region. The first region corresponds to the back side of the medium carrying portion 70 provided to the upper surface 72. The second region corresponds to the back side of the region of the upper surface 72 excluding the medium carrying portion 70.

As illustrated in FIG. 3A, the respective positions in the horizontal directions 9 of the pinch rollers 141 and 144 are in a range in which, when the medium tray 71 passes the first roller pair 58, the pinch rollers 141 and 144 press only the second region and do not press the first region (a first range R1). Meanwhile, the respective positions in the horizontal directions 9 of the pinch rollers 142 and 143 are in a range in which, when the medium tray 71 passes the first roller pair 58, the pinch rollers 142 and 143 can press the first region (a second range R2).

Each of the pinch rollers 141 to 144 is placed at a position facing only either one of the first region and the second region. This means that the position in the horizontal directions 9 of each of the pinch rollers 141 to 144 is in either one of the first range R1 and the second range R2, and that each of the pinch rollers 141 to 144 is not located partially in the first range R1 and partially in the second range R2.

[Movement of Pinch Rollers]

As illustrated in FIG. 2, the pinch rollers 61 are movable between a first position (the position indicated by a solid line in FIG. 2) and a second position below the first position (the position indicated by a broken line in FIG. 2). The pinch rollers 61 at the first position are in contact with the first convey roller 60, and are capable of conveying a recording sheet by nipping the recording sheet between the pinch rollers 61 and the first convey roller 60. The pinch rollers 61 at the second position form a clearance between the pinch rollers 61 and the first convey roller 60, which is slightly less than the thickness in the vertical directions 7 of the medium tray 71, and are capable of conveying the medium tray 71 by nipping the medium tray 71 between the pinch rollers 61 and the first convey roller 60.

To achieve the above-described movement of the pinch rollers 61, the printer 11 is provided with the roller support members 94 (see FIG. 2) formed by side end portions 151 and lower portions 152, and a first eccentric cam formed by discs 98 and a first shaft 99, as illustrated in FIGS. 4A and 4B. The roller support member 94 is an example of a first supporting member, a second supporting member.

The side end portions 151 are provided to left and eight end portions of the pinch rollers 141 to 144. The lower portions 152 are provided under the pinch rollers 141 to 144. As illustrated in FIGS. 5A to 9B, the side end portions 151 and the lower portions 152 are integrally formed.

A lower portion of each of the side end portions 151 is provided with an opening 153 in the horizontal directions 9. The first shaft 99 described later pieces through the opening 153. An opening 153*a* (see FIG. 5A) provided to the side end portions 151 corresponding to the pinch rollers 142 and 143 is smaller than an opening 153*b* (see FIG. 5B) provided to the side end portions 151 corresponding to the pinch rollers 141 and 144. An upper portion of each of the side end portions 151 is provided with a recess 154. In the recess 154, a rotary shaft 120 of the pinch rollers 141 to 144 is supported by the second resilient members 92 described later.

The discs 98 (see FIGS. 4A and 4B) are rotated with drive transmitted thereto from a not-illustrated first cam motor. As illustrated in FIGS. 4A and 4B, the first shaft 99 (an example of a press-down mechanism) is attached to each of the discs 98 at a position apart from the rotation center of the disc 98 toward the circumference of the disc 98 by a predetermined value. The predetermined value is determined on the basis of the movement amount by which the pinch rollers 61 move between the first position and the second position.

Figure 5A:
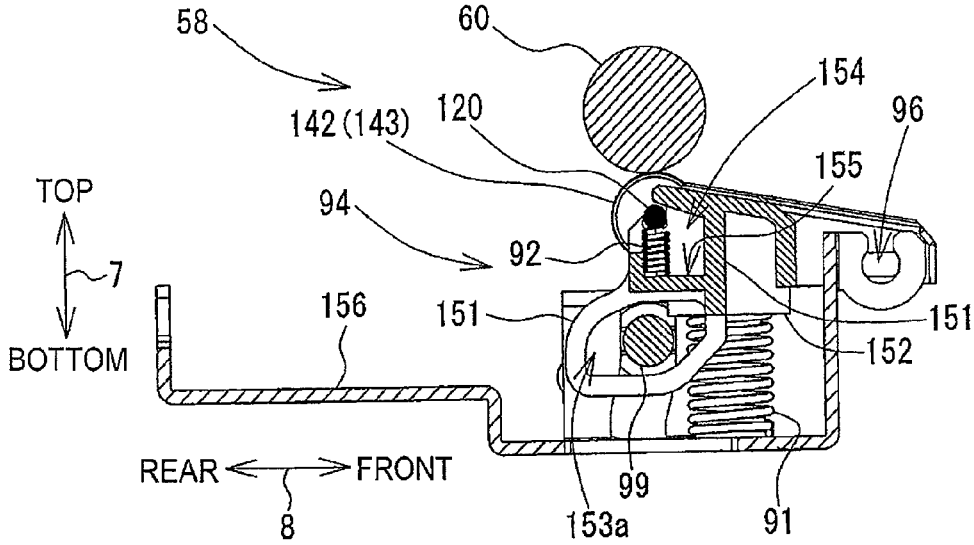
FIGS. 5A and 5B are vertical cross-sectional views schematically illustrating the first roller pair for conveying the recording sheet, FIG. 5A illustrating a pinch roller facing a first region, and FIG. 5B illustrating another pinch roller facing a second region.
Figure 5B:
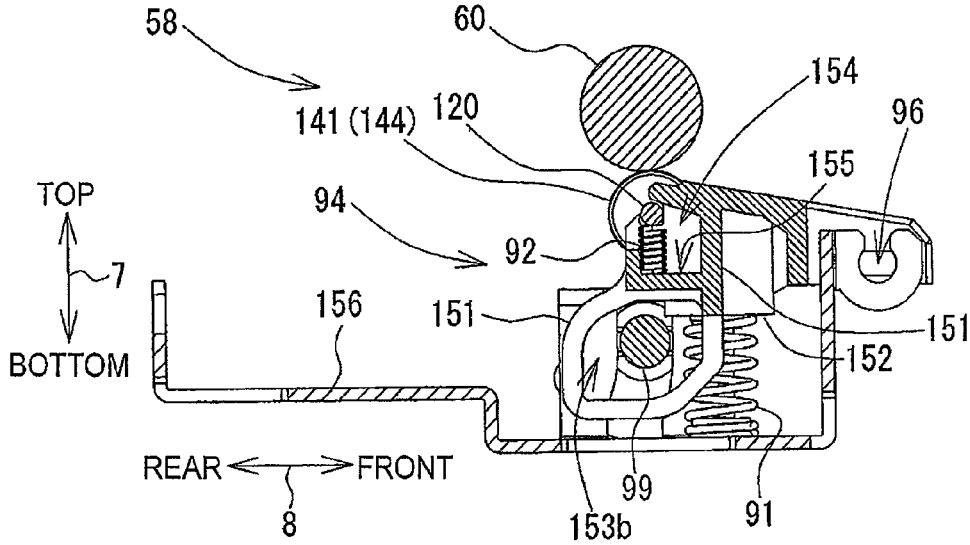
Figure 6A:
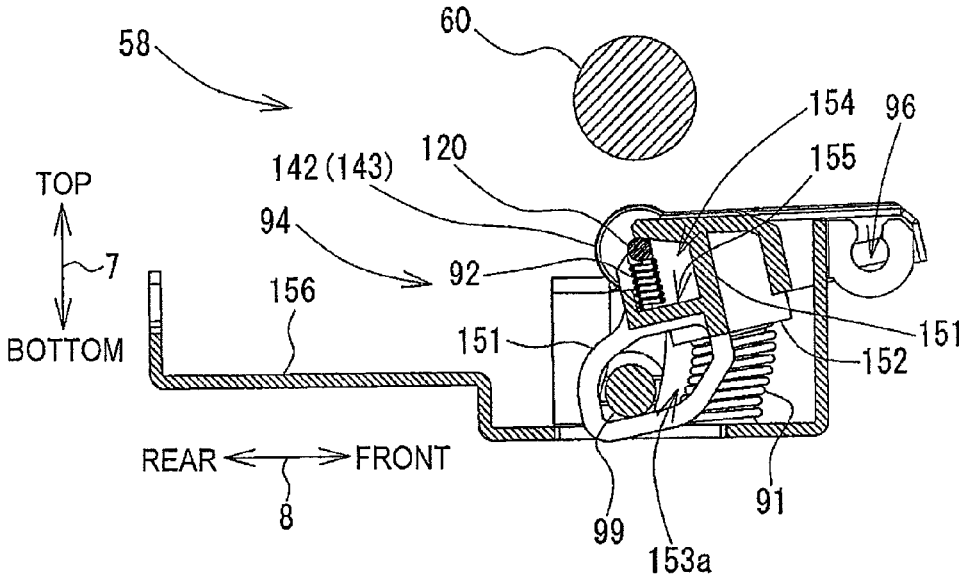
FIGS. 6A and 6B are vertical cross-sectional views schematically illustrating the first roller pair with the pinch rollers moved to a second position, FIG. 6A illustrating the pinch roller facing the first region, and FIG. 6B illustrating the another pinch roller facing the second region.
Figure 6B:
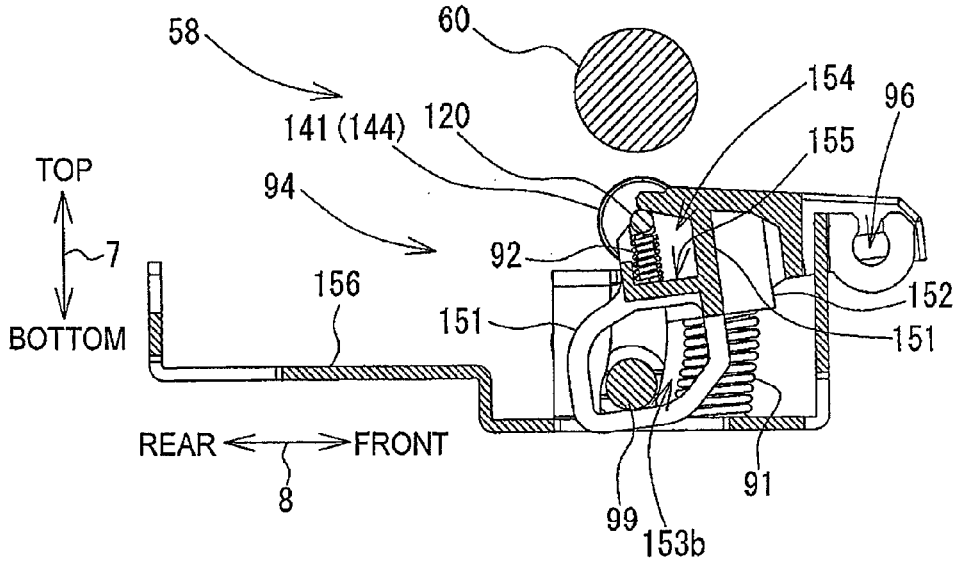

As illustrated in FIG. 4A, when the pinch rollers 61 are located at the first position, the first shaft 99 is located above the center of the discs 98. As the first eccentric cam rotates, the first shaft 99 moves along the locus of a circle having a radius corresponding to a predetermined value. Thereby, the first shaft 99 is located below the center of the discs 98 (see FIG. 4B). Specifically, as illustrated in FIGS. 5A and 5B, with the bottom surface of the opening 153 of each of the side end portions 151 pressed downward by the first shaft 99, the roller support members 94 pivot around a shaft 96 and move downward. Thereby, the pinch rollers 61 are located at the second position, as illustrated in FIGS. 6A and 6B. Accordingly, the first eccentric cam rotates while supporting the roller support members 94, and thereby moves the roller support members 94 in the vertical directions 7.

[Adjustment of Pressing Force]

When the pinch rollers 61 are located at the second position, the pressing force applied by the pinch rollers 142 and 143 to the medium tray 71 is adjusted to be lower than the pressing force applied by the pinch rollers 141 and 144 to the medium tray 71. To achieve such adjustment of the pressing forces, the printer 11 is provided with the first resilient members 91 (an example of a first urging member, a second urging member, a first-first urging member, a first-second urging member) and the second resilient members 92 (an example of a first urging member, a second urging member, a second-first urging member, a second-second urging member), as illustrated in FIGS. 4A to 9B.

Each of the resilient members 91 and 92 is a coil spring in the present embodiment, but is not limited to the coil spring and may be a torsion spring, for example. In the present embodiment, a spring higher in spring constant than the second resilient members 92 is used to form the first resilient members 91.

As illustrated in FIGS. 5A and 5B, one first resilient member 91 is provided under each of the pinch rollers 141 to 144. The upper end of the first resilient member 91 is attached to the lower surface of the corresponding lower portion 152, and the lower end of the first resilient member 91 is attached to a frame 156 fixed to the printer 11.

As illustrated in FIGS. 4A and 4B, two second resilient members 92 are provided under each of the pinch rollers 141 to 144. As illustrated in FIGS. 4A to 5B, at the left and right ends of each of the pinch rollers 141 to 144, the upper end of each of the second resilient members 92 supports the rotary shaft 120 to be rotatable. Further, the lower end of each of the second resilient members 92 is attached to a bottom surface 155 of the recess 154.

As illustrated in FIGS. 5A and 5B, when the pinch rollers 141 to 144 are located at the first position, the first resilient members 91 bias the pinch rollers 141 to 144 upward via the lower portions 152. Further, the second resilient members 92 also bias the pinch rollers 141 to 144 upward. That is, the respective pressing forces applied by the pinch rollers 141 to 144 to the medium tray 71 are equivalent. A position where the pinch rollers 142 and 143 contact the first convey roller 60 is an example of a first basic position (see FIG. 5A), a position where the pinch rollers 141 and 144 contact the first convey roller 60 is an example of a second basic position (see FIG. 5B).

When the pinch rollers 141 to 144 are located at the first position, if the discs 98 rotate and the first shaft 99 moves downward, the side end portions 151 are pressed by the first shaft 99, and thereby the roller support members 94 move downward. As a result, the pinch rollers 141 to 144 also move downward. In this process, the pinch rollers 142 and 143 start moving downward before the pinch rollers 141 and 144 start moving downward. This is because the lower end of the first shaft 99 reaches the bottom surface of the opening 153 faster in FIG. 5A than in FIG. 5B due to the difference in size of the opening 153.

When the pinch rollers 141 to 144 reach the second position, the position of the pinch rollers 142 and 143 (see FIG. 6A) is below the position of the pinch rollers 141 and 144 (see FIG. 6B) due to the difference in movement start timing. The clearance between the pinch rollers 142 and 143 and the first convey roller 60 and the clearance between the pinch rollers 141 and 144 and the first convey roller 60 are both slightly less than the thickness in the vertical directions 7 of the medium tray 71. In the state of FIGS. 6A and 6B, the lower end of the first shaft 99 and the bottom surface of the opening 153 are in contact with each other. Therefore, the roller support members 94 are not biased upward by the first resilient members 91. That is, the upward biasing by the first resilient members 91 is cancelled.

Figure 7A:
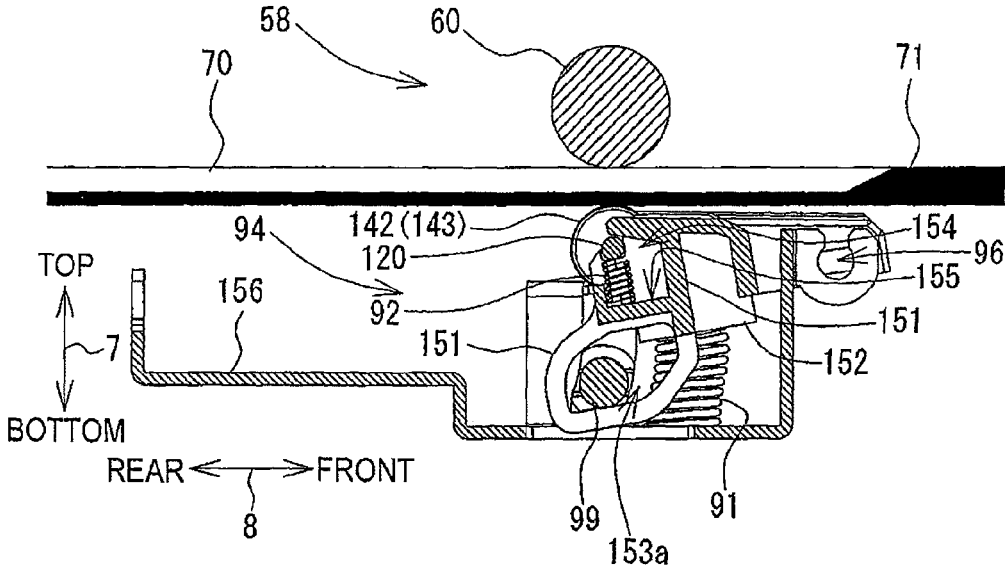
FIGS. 7A and 7B are vertical cross-sectional views schematically illustrating the first roller pair conveying the medium tray, FIG. 7A illustrating the pinch roller facing the first region, and FIG. 7B illustrating the another pinch roller facing the second region.
Figure 7B:
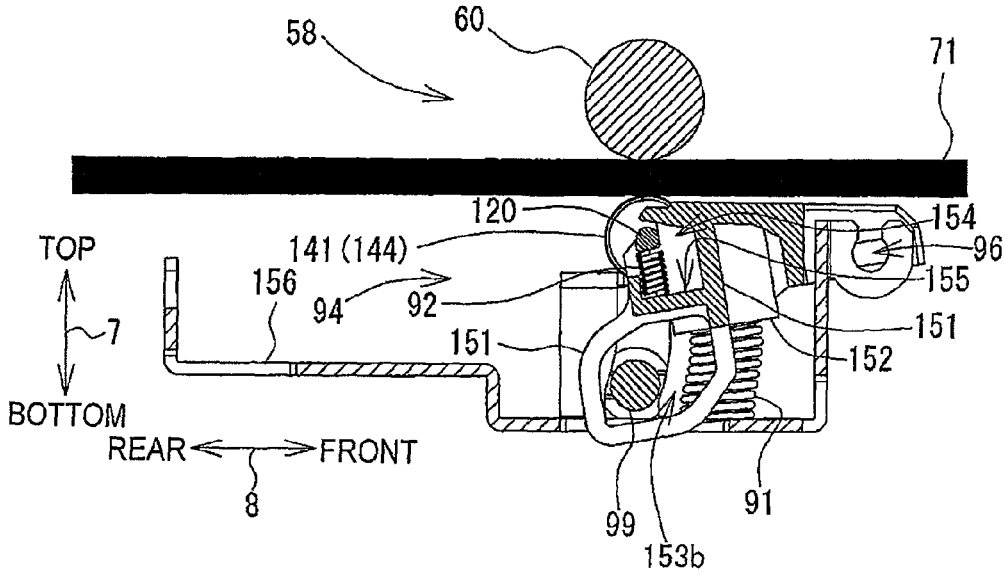

If the medium tray 71 is inserted when the pinch rollers 141 to 144 are located at the second position, the medium tray 71 is nipped by the first roller pair 58 while pressing the pinch rollers 141 to 144 downward, as illustrated in FIGS. 7A and 7B. A position where the pinch rollers 142 and 143 nip the medium tray with the first convey roller 60 is an example of a first nip position (see FIG. 7A), a position where the pinch rollers 141 and 144 nip the medium tray with the first convey roller 60 is an example of a second nip position (see FIG. 7B).

In this process, the force of the medium tray 71 for pressing the pinch rollers 142 and 143 downward is absorbed by the second resilient members 92. Thereby, as illustrated in FIG. 7A, the lower end of the first shaft 99 and the bottom surface of the opening 153*a* of the corresponding side end portion 151 are kept in contact with each other. As a result, the upward biasing by the first resilient members 91 remains cancelled. Meanwhile, the force of the medium tray 71 for pressing the pinch rollers 141 and 144 downward is not completely absorbed by the second resilient members 92. As a result, the roller support members 94 are pressed downward by a part of the force of the medium tray 71 for pressing the pinch rollers 141 and 144 downward. Thereby, as illustrated in FIG. 7B, the lower end of the first shaft 99 and the bottom surface of the opening 153*b* of the corresponding side end portion 151 are separated from each other. Consequently, the upward biasing by the first resilient members 91 is not cancelled.

Accordingly, when the pinch rollers 61 are located at the first position, the pinch rollers 141 to 144 are biased by the first resilient members 91 and the second resilient members 92. Meanwhile, when the pinch rollers 61 are located at the second position, the pinch rollers 141 and 144 are biased by the first and second resilient members 91 and 92, but the pinch rollers 142 and 143 are biased only by the second resilient members 92. Thus, a difference between the pressing force applied by the pinch rollers 142 and 143 and the pressing force applied by the pinch rollers 141 and 144 when the pinch rollers 141 to 144 contact the first convey roller 60 is smaller than a difference between the pressing force applied by the pinch rollers 142 and 143 and the pressing force applied by the pinch rollers 141 and 144 when the pinch rollers 141 to 144 contact the medium tray 71. Furthermore, when the pinch rollers 141 to 144 contact the medium tray 71, the pressing force applied by the pinch rollers 142 and 143 is smaller than the pressing force applied by the pinch rollers 141 and 144.

[Movement in Vertical Directions 7 of Platen 42]

As illustrated in FIG. 2, the printer 11 is provided with a member operating mechanism 95. The member operating mechanism 95 moves the platen 42 in the vertical directions 7. The member operating mechanism 95 includes the platen support member 53 for supporting the platen 42 and a second eccentric cam 97 for changing the posture of the platen support member 53. The member operating mechanism 95 is not limited to the configuration of the present embodiment, as long as the member operating mechanism 95 is capable of exerting the above-described function.

The platen support member 53 and the platen 42 supported by the platen support member 53 are configured to be able to change the posture thereof between a first posture (the posture indicated by a solid line in FIG. 2) and a second posture (the posture indicated by a broken line in FIG. 2) in accordance with the movement thereof in the vertical directions 7.

When the platen support member 53 is in the first posture, the width along the vertical directions 7 of the path 65 corresponds to a first width 28 (see FIG. 10A) allowing a recording sheet to pass therethrough. Meanwhile, when the platen support member 53 is in the second posture, the width along the vertical directions 7 of the path 65 corresponds to a second width 29 (see FIG. 10B) greater than the first width 28 and allowing the medium tray 71 to pass there through.

Figure 10B:
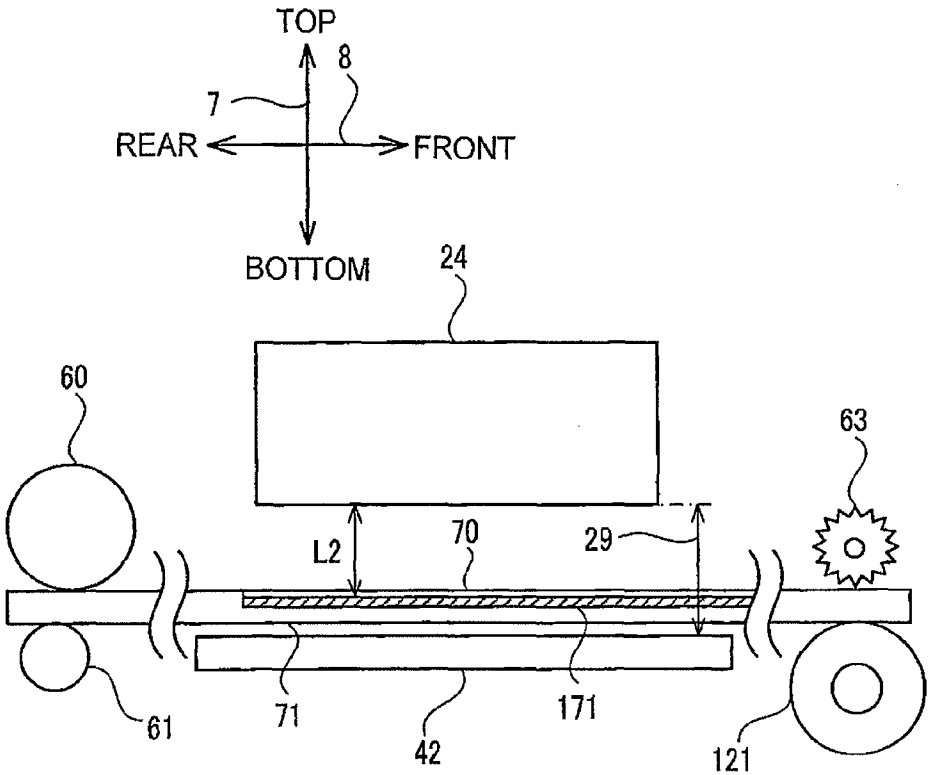
FIGS. 10A and 10B are vertical cross-sectional views schematically illustrating the recording sheet and the medium tray being conveyed between a recording unit and a platen.
Figure 10A:
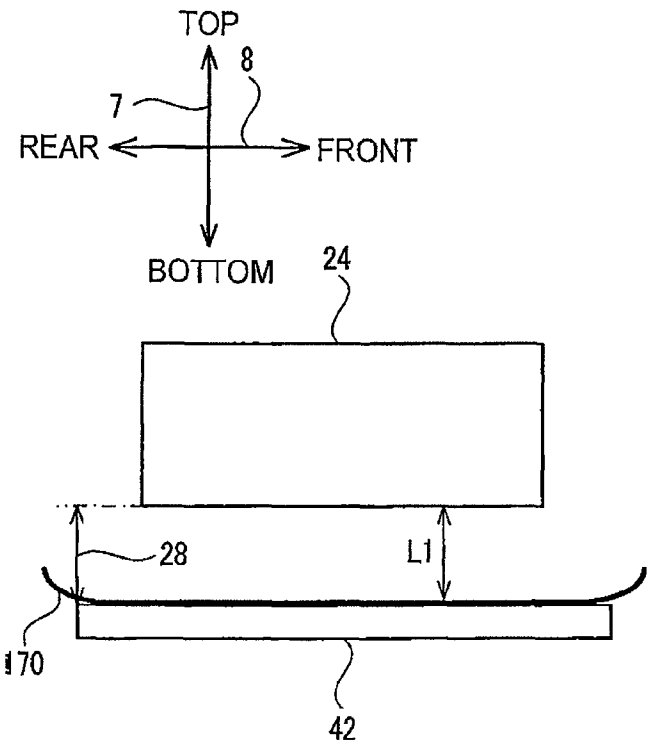

As illustrated in FIGS. 10A and 10B, a distance L1 between the lower surface of the recording unit 24 and the upper surface of a recording sheet 170 supported by the platen 42 in the first posture is equal to a distance L2 between the lower surface of the recording unit 24 and the upper surface of a recording medium 171 placed on the medium carrying portion 70 of the medium tray 71 nipped at a nip position of nipping by the first roller pair 58 and the second roller pair 59 located at the second position. The distances L1 and L2 are not required to be completely the same, and may have a substantially equal relationship with each other.

The second eccentric cam 97 (an example of an eccentric cam) is located under and in contact with the platen support member 53. The second eccentric cam 97 is rotatably supported by, for example, the frame of the printer 11, with the direction of the axis line thereof extending along the horizontal directions 9 and a second shaft 100 serving as a rotary shaft thereof. The second eccentric cam 97 is formed by a disc, the radius of which from the second shaft 100 changes periodically. With drive transmitted from a not-illustrated second cam motor, the second eccentric cam 97 is rotated. As the second eccentric cam 97 is rotated, the circumferential surface thereof is slidingly moved on the platen support member 53. The radius of the circumferential surface of the second eccentric cam 97 from the second shaft 100 changes periodically. Due to this change, therefore, the platen support member 53 moves in the vertical directions 7.

[Image Recording on Recording Medium]

Description will be made below of a procedure in which the medium tray 71 is inserted into the multi-function device 10 and an image is recorded on a recording medium placed on the medium tray 71. Upon issuance by not-illustrated instruction device of an instruction for recording an image on the recording medium, the first eccentric cam is rotated, and the pinch rollers 61 move downward, as illustrated in FIG. 2. Further, the second eccentric cam 97 is rotated, and the platen 42 moves downward. That is, a change in posture from the first posture to the second posture occurs.

Thereafter, the medium tray 71 is inserted by a user of the multi-function device 10 through the opening 13 on the front side of the multi-function device 10 along the path 65 in the direction of the arrow 77 opposite to the conveying direction. In this process, the medium tray 71 is inserted as placed on the tray guide 76. Upon detection by a not-illustrated sensor of the insertion of the medium tray 71, the first convey roller 60 and the second convey roller 62 are driven to rotate in reverse.

When the medium tray 71 inserted by the user comes into contact with the second roller pair 59, the spur rollers 63 are pushed by the upper surface 72 of the medium tray 71 and thereby moved upward. As a result, the medium tray 71 is nipped and conveyed by the second roller pair 59 in the opposite direction to the conveying direction. In the present embodiment, description is made of the configuration in which the spur rollers 63 are pushed by the upper surface 72 of the medium tray 71 and thereby moved upward, as described above. However, the configuration may be modified such that at least one of the spur rollers 63 and the second convey roller 62 can be moved by an eccentric cam and so forth similarly to the platen support member 53.

The medium tray 71 conveyed by the second roller pair 59 passes under the recording unit 24, and the upstream side thereof in the conveying direction of the recording sheet comes into contact with the first roller pair 58. The medium tray 71 nipped by the first roller pair 58 and the second roller pair 59 is guided further upstream in the conveying direction of the recording sheet. In this process, the pinch rollers 141 to 144 press the medium tray 71 with respective pressing forces, which vary depending on the regions faced by the pinch rollers 141 to 144, as described above.

Thereby, the recording medium placed on the medium tray 71 is located upstream of the recording unit 24 in the conveying direction of the recording sheet. Then, the rotation direction of the first convey roller 60 and the second convey roller 62 is shifted from the reverse direction to the forward direction. Thereby, the medium tray 71 is conveyed in the conveying direction of the recording sheet, and the recording medium placed on the medium tray 71 passes over the platen 42. The recording head 38 discharges ink droplets onto the recording medium conveyed on the platen 42. Thereby, an image is recorded on a disc surface of the recording medium. Thereafter, the medium tray 71 is discharged.

In the above-described embodiment, description has been made of the configuration in which the recording unit 24, the first convey roller 60, and the spur rollers 63 are placed above the path 65 while the pinch rollers 61 and the second convey roller 62 are placed below the path 65. However, the placement of these components may be different from the placement in the above-described embodiment. For example, if the present invention is applied to the multi-function device 10 in which at least a part of the path 65 is formed in the vertical directions 7, the recording unit 24 and the spur rollers 63 may be placed on the left side of the path 65, and the second convey roller 62 may be placed on the right side of the path 65.

Further, in the above-described embodiment, description has been made of the configuration in which each of the pinch rollers 141 to 144 is placed at a position facing only either one of the first region and the second region. However, each of the pinch rollers 141 to 144 may be placed at a position facing both the first region and the second region.

[Effects of Embodiment]

The back side of the first region, i.e., the upper surface 72 of the medium tray 71 is provided with the medium carrying portion 70. Therefore, the thickness of the medium tray 71 in the first region is less than the thickness of the medium tray 71 in the second region. If the entire area of the lower surface of such a medium tray 71 is applied with equal pressing forces by the pinch rollers 61, the medium tray 71 is warped. In the above-described embodiment, however, when the medium tray 71 carrying thereon a recording medium is conveyed through the path 65, the pressing force applied by the pinch rollers 142 and 143 to the first region is adjusted to be lower than the pressing force applied by the pinch rollers 141 and 144 to the second region. Accordingly, the medium tray 71 is reduced warping. It is therefore possible to stabilize the height of a surface of the recording medium placed on the medium tray 71, on which an image is to be recorded. Consequently, it is possible to reduce the deterioration of the quality of the image recorded on the recording medium.

In the above-described embodiment, when the pinch rollers 61 are located at the second position, the pinch rollers 142 and 143 facing the first region press the medium tray 71 only with the biasing force of the second resilient members 92, and the pinch rollers 141 and 144 facing the second region press the medium tray 71 with the biasing force of the first resilient members 91 in addition to the biasing force of the second resilient members 92. That is, it is possible to adjust the pressing force applied by the pinch rollers 142 and 143 to the first region to be lower than the pressing force applied by the pinch rollers 141 and 144 to the second region.

In the above-described embodiment, the recording medium placed on the medium carrying portion 70 has the surface facing the recording unit 24 and located below the region in the upper surface 72 of the medium tray 71 excluding the medium carrying portion 70. Further, the first convey roller 60 comes into contact with the upper surface 72 of the medium tray 71, and thus is not located below the upper surface 72 of the medium tray 71. In the above-described embodiment, therefore, it is possible to reduce the first convey roller 60 from coming into contact with the recording medium placed on the medium carrying portion 70 of the medium tray 71.

In the above-described embodiment, the distance L1 between the recording unit 24 and the upper surface of a recording sheet, on which an image is recorded, is the same as the distance L2 between the recording unit 24 and the upper surface of a recording medium, on which an image is recorded. Therefore, there is no need to change the image recording method performed by the recording unit 24 depending on whether an image is recorded on a recording sheet or on a recording medium. In other words, the recording unit 24 is not required to include a mechanism allowing the image recording to be performed in two or more methods. That is, it is possible to reduce the mechanism of the recording unit 24 from becoming complicated.

When a pinch roller 61 is placed at a position facing both the first region and the second region, if the pressing force of the pinch roller 61 provided by the resilient members 91 and 92 is adjusted on the assumption that the pinch roller 61 faces the second region, the medium tray 71 may be warped. Meanwhile, if the above-described adjustment is made on the assumption that the pinch roller 61 faces the first region, the pressing force applied to the medium tray 71 is reduced, and the conveying force for conveying the medium tray 71 is reduced. In the above-described embodiment, however, each of the pinch rollers 61 is placed at a position facing only either one of the first region and the second region. Accordingly, it is possible to reduce the warp of the medium tray 71 and the reduction in conveying force for conveying the medium tray 71 described above.

[Modified Example of Embodiment]

In the above-described embodiment, description has been made of the case in which the pinch rollers 141 to 144 at the second position are in contact with the lower surface of the medium tray 71. However, as illustrated in FIGS. 8A to 9B, among the pinch rollers 61 located at the second position, the pinch rollers 142 and 143 provided in the second range R2 may be moved to a third position below the lower surface of the medium tray 71 (see FIG. 9A). Further, the pinch rollers 141 and 144 provided in the first range R1 may be moved to a fourth position below the first position and above the lower surface of the medium tray 71 (see FIG. 9B). In other words, in the conveyance of the medium tray 71, the pinch rollers 142 and 143 may be separated from the medium tray 71 such that the medium tray 71 is conveyed only by the pinch rollers 141 and 144. Description will be made below of features of the modified example different from the features of the above-described embodiment.

Figure 8A:
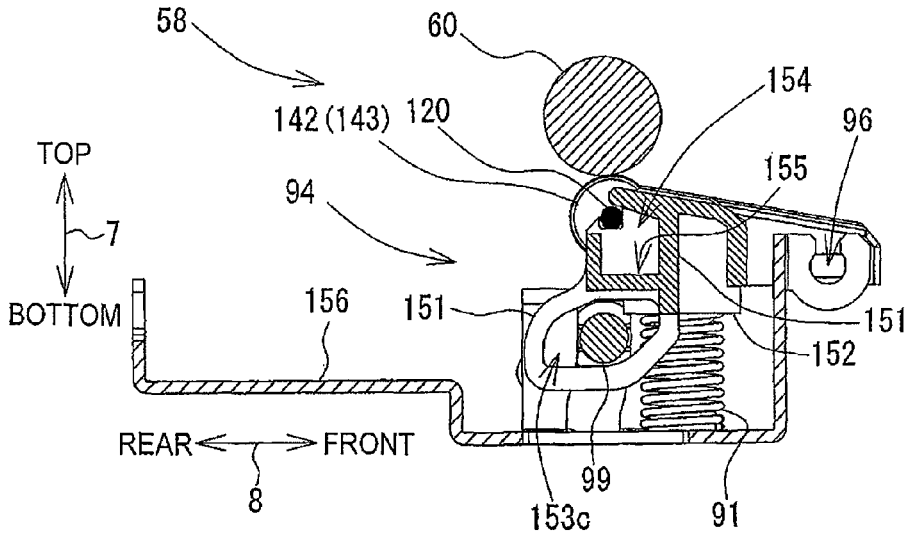
FIGS. 8A and 8B are vertical cross-sectional views schematically illustrating the first roller pair for conveying the recording sheet in a modified example, FIG. 8A illustrating the pinch roller facing the first region, and FIG. 8B illustrating the another pinch roller facing the second region.

As illustrated in FIG. 8A, a configuration for realizing the modified example is attained by an opening 153*c* provided to the side end portions 151 corresponding to the pinch rollers 142 and 143, which is formed to be smaller in size than the corresponding opening of the above-described embodiment.

In the configuration of FIG. 8A, due to the opening 153*c* formed into a small size, the lower end of the first shaft 99 reaches the bottom surface of the opening 153*c* with a smaller movement amount than the movement amount of the above-described embodiment. Therefore, with the first shaft 99 moved by the same amount as the amount of the above-described embodiment, the pinch rollers 142 and 143 are allowed to move to a position below the second position reached by the pinch rollers 142 and 143 after the movement thereof in the above-described embodiment and also below the lower surface of the medium tray 71, i.e., the third position (see FIG. 9A).

Figure 8B:
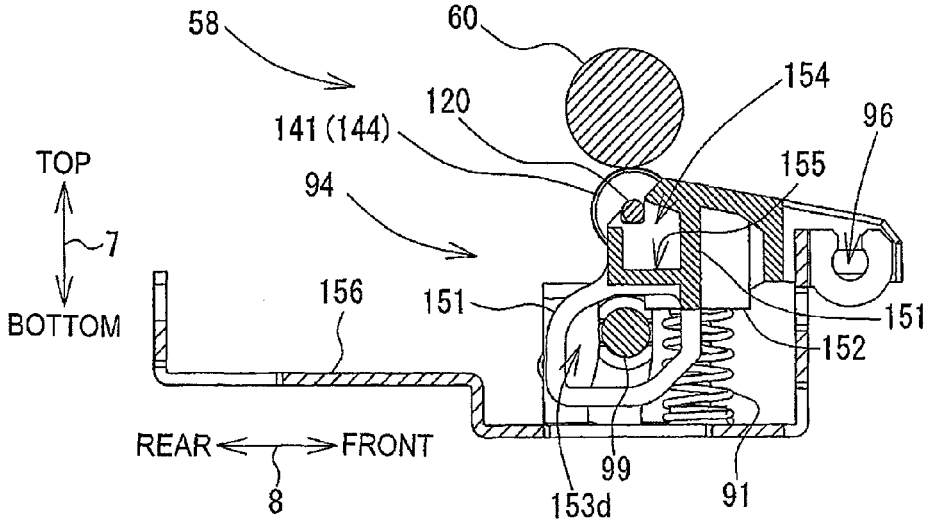

Meanwhile, as illustrated in FIG. 8B, the size of an opening 153*d* is similar to the size of the corresponding opening of the above-described embodiment (see FIG. 5B). Therefore, with the first shaft 99 moved by the same amount as the amount of the above-described embodiment, the pinch rollers 141 and 144 are moved to the second position similarly to the above-described embodiment (see FIG. 9B). Herein, the second position is below the first position but above the lower surface of the medium tray 71. That is, in the present modified example, the fourth position is the same as the second position of the above-described embodiment.

Accordingly, when the pinch rollers 141 and 144 are moved from the first position to the fourth position, the pinch rollers 142 and 143 are moved from the first position to the third position, i.e., a position below the fourth position.

As illustrated in FIGS. 8A to 9B, the pinch roller moving mechanism of the modified example includes only the first resilient members 91. Therefore, the rotary shaft 120 is rotatably supported not by the second resilient members 92 but by the lower portions 152 of the roller support members 94.

Figure 9A:
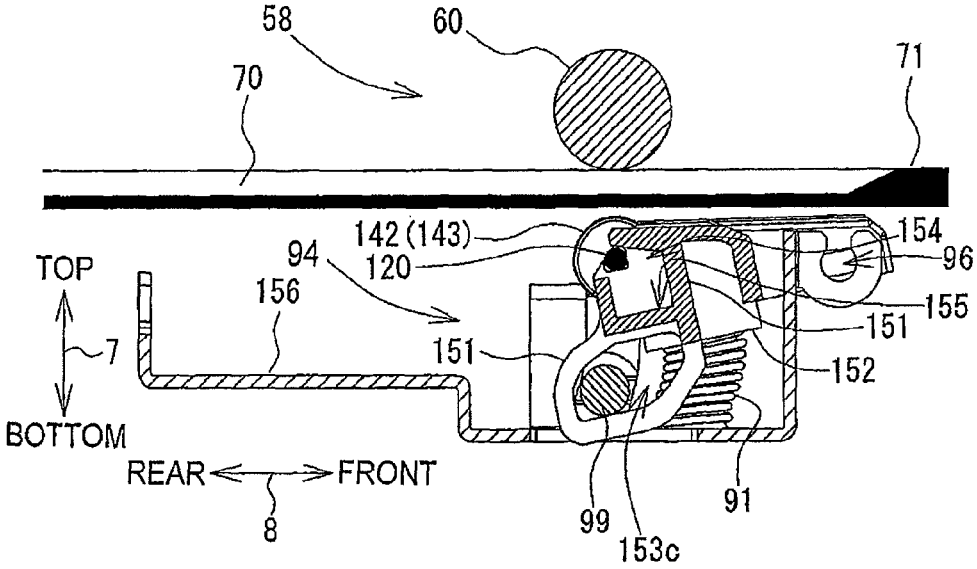
FIGS. 9A and 9B are vertical cross-sectional views schematically illustrating the first roller pair conveying the medium tray in the modified example, FIG. 9A illustrating the pinch roller facing the first region, and FIG. 9B illustrating the another pinch roller facing the second region.
Figure 9B:
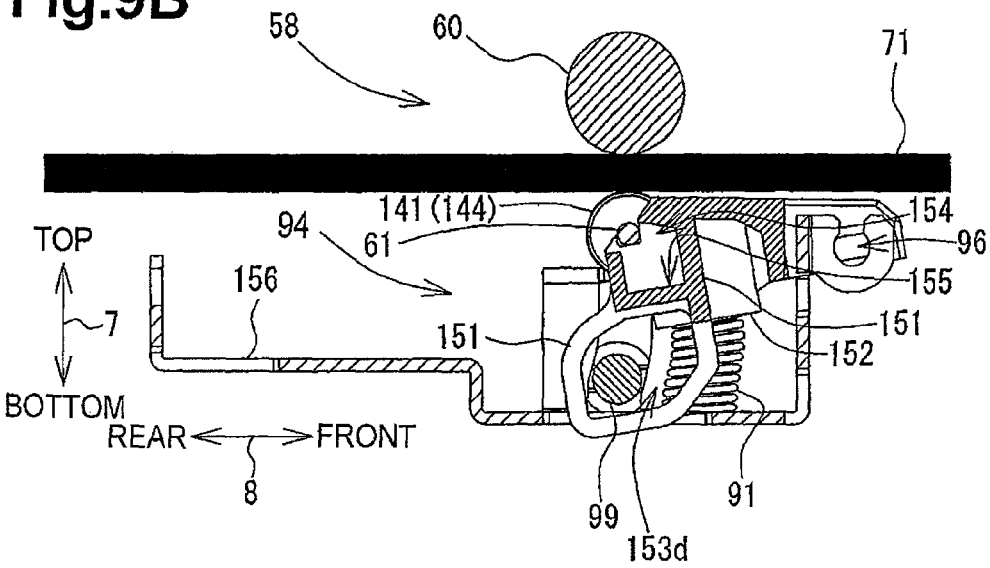

Accordingly, the pinch rollers 141 and 144 are biased by the first resilient members 91, whether the pinch rollers 141 and 144 are located at the first position or the fourth position (see FIG. 9B). Meanwhile, the pinch rollers 142 and 143 are biased by the first resilient members 91 when located at the first position, but are separated from the lower surface of the medium tray 71 when located at the third position (see FIG. 9A).

Similarly to the description of the above-described embodiment, the thickness of the medium tray 71 also varies in the modified example, depending on the region in the lower surface of the medium tray 71. Therefore, if the entire area of the lower surface of the medium tray 71 is applied with equal pressing force, the medium tray 71 is warped. In the above-described embodiment, however, when the medium tray 71 carrying thereon a recording medium is conveyed through the path 65, the pinch rollers 142 and 143 are moved by the first eccentric cam to the third position at which the pinch rollers 142 and 143 do not come into contact with the medium tray 71. Further, the pinch rollers 141 and 144 are moved by the first eccentric cam to the fourth position at which the pinch rollers 141 and 144 come into contact with the medium tray 71. That is, only the second region in the lower surface of the medium tray 71 is applied with the pressing force by the pinch rollers 141 and 144. Accordingly, it is possible to reduce the medium tray 71 from being warped. Consequently, it is possible to stabilize the height of the image recording surface of the recording medium placed on the medium tray 71, and to reduce the deterioration of the quality of the image recorded on the recording medium.

The pinch rollers 142 and 143 facing the first region are moved from the first position to the third position together with the first guide members moved by the first eccentric cam by the first movement amount. Further, the pinch rollers 141 and 144 facing the second region are moved from the first position to the fourth position together with the second guide members moved by the first eccentric cam. Accordingly, it is possible to apply the pressing force of the pinch rollers 141 and 144 only to the second region in the lower surface of the medium tray 71.

What is claimed is:

1. An image recording device comprising:

a tray comprising a recess configured to receive therein a recording medium;

a recording unit configured to record an image on the recording medium;

a drive roller configured to feed the tray with the recording medium placed on the recess by rotating with a drive force transmitted from a drive source;

a first driven roller disposed facing the drive roller;

a second driven roller disposed facing the drive roller and adjacent to the first driven roller in a width-wise direction;

a first urging member configured to urge the first driven roller toward the drive roller;

a second urging member configured to urge the second driven roller toward the drive roller;

a first supporting member supporting the first driven roller;

a second supporting member supporting the second driven roller; and a shifter configured to move between a first shifter position and a second shifter position, configured to shift the first supporting member, by contacting the first supporting member without contacting the first driven roller, in a direction that is away from the first driven roller, and configured to shift the second supporting member, by contacting the second supporting member without contacting the second driven roller, in a direction that is away from the second driven roller, wherein the shifter causes the first driven roller to be movable between a first basic position, in which the first driven roller is configured to contact the drive roller and press toward the drive roller with a first force, and a first nip position, in which the first driven roller is configured to press a first portion of the tray toward the drive roller with a third force, the drive roller and the first driven roller configured such that the recess of the tray passes between the drive roller and the first driven roller, wherein the shifter causes the second driven roller to be movable between a second basic position, in which the second driven roller is configured to contact the drive roller and press toward the drive roller with a second force, and a second nip position, in which the second driven roller is configured to press a second portion of the tray toward the drive roller with a fourth force, the drive roller and the second driven roller configured such that the recess of the tray does not pass between the drive roller and the second driven roller, and wherein a difference between the first force of the first driven roller under a condition that the first supporting member is not shifted by the shifter and the second force of the second driven roller under a condition that the second supporting member is not shifted by the shifter is smaller than a difference between the third force of the first driven roller under a condition that the first supporting member is shifted by the shifter and the fourth force of the second driven roller under a condition that the second supporting member is shifted by the shifter, and the third force is smaller than the fourth force.

2. The image recording device according to claim 1, wherein the third force is zero.

3. The image recording device according to claim 1, wherein the first supporting member is supported by the first urging member, and wherein the second supporting member is supported by the second urging member.

4. The image recording device according to claim 3, further comprising a fixed frame, wherein the first urging member comprises a first-first urging member and a second-first urging member, and the second urging member comprises a first-second urging member and a second-second urging member, wherein the fixed frame supports the first supporting member via the first-first urging member and supports the second supporting member via the first-second urging member, and the first supporting member supports the first driven roller via the second-first urging member and the second supporting member supports the second driven roller via the second-second urging member.

5. The image recording device according to claim 4, wherein a spring constant of the first-first urging member is higher than a spring constant of the first-second urging member.

6. The image recording device according to claim 1, wherein the first supporting member is configured to support the first urging member, which supports a rotary shaft of the first driven roller; and wherein the second supporting member is configured to support the second urging member, which supports a rotary shaft of the second driven roller.

7. The image recording device according to claim 1, further comprising a press-down mechanism, the press-down mechanism being configured to press the first supporting member and the second supporting member downward, wherein a distance that the press-down mechanism moves the first supporting member by pressing-down is larger than a distance that the press-down mechanism moves the second supporting member by pressing-down.

8. The image recording device according to claim 1, wherein a depth of the recess is more than a thickness of the recording medium.

9. The image recording device according to claim 1, further comprising:

a platen disposed facing the recording unit and configured to support the recording medium;

a platen supporting member configured to support the platen from below; and an eccentric cam configured to support the platen supporting member from below and to move the platen supporting member by rotating such that the recording medium passes through on the platen.

10. The image recording device according to claim 1, wherein the recess has a circular shape.

11. The image recording device according to claim 1, wherein the recess has an oblong shape and extends from an upstream end to a downstream end of the tray.

12. The image recording device according to claim 1, wherein the first force and the second force are equivalent.

13. The image recording device according to claim 1, wherein the shifter is further configured to shift the second supporting member.

* * * * *